US011401853B2

(12) United States Patent
Spurling et al.

(10) Patent No.: US 11,401,853 B2
(45) Date of Patent: Aug. 2, 2022

(54) SYSTEMS FOR A FASTENING DEVICE OF AN EXHAUST-GAS AFTERTREATMENT SYSTEM

(71) Applicant: Ford Global Technologies, LLC, Dearborn, MI (US)

(72) Inventors: Michael Spurling, Romford (GB); Marius Sawatzki, Pulheim (DE); Daniel Meckenstock, Wuppertal (DE)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/112,507

(22) Filed: Dec. 4, 2020

(65) Prior Publication Data

US 2021/0172364 A1 Jun. 10, 2021

(30) Foreign Application Priority Data

Dec. 5, 2019 (DE) ..... 102019133107.2

(51) Int. Cl.

| | |
|---|---|
| ***F01N 5/04*** | (2006.01) |
| ***F01N 13/18*** | (2010.01) |
| ***F02B 37/00*** | (2006.01) |

(52) U.S. Cl.

CPC ..... *F01N 5/04* (2013.01); *F01N 13/1844* (2013.01); *F02B 37/00* (2013.01); *F05B 2220/40* (2013.01)

(58) Field of Classification Search

CPC .... F01N 5/04; F01N 13/1844; F01N 2450/22; F01N 13/1827; F01N 13/1894; F01N 2340/06; F01N 13/1811; F01N 13/08; F01N 3/28

USPC ..... 60/605.1

See application file for complete search history.

(56) References Cited

U.S. PATENT DOCUMENTS

| | | | | |
|---|---|---|---|---|
| 3,942,599 | A * | 3/1976 | Shimada | B60K 13/04 180/292 |
| 4,339,919 | A * | 7/1982 | Jobling | F01N 13/1822 180/296 |
| 4,559,776 | A * | 12/1985 | Arai | F02B 37/00 60/280 |
| 9,481,238 | B2 * | 11/2016 | Tiefenbacher | B62D 21/15 |
| 10,480,378 | B2 * | 11/2019 | Kamo | F01N 5/04 |
| 10,801,397 | B2 * | 10/2020 | Meckenstock | F02B 39/16 |
| 10,883,405 | B1 * | 1/2021 | Hornback | F01N 13/1855 |
| 2015/0101329 | A1 * | 4/2015 | Tiefenbacher | B62D 21/15 60/605.1 |
| 2018/0094566 | A1 * | 4/2018 | Meckenstock | F01N 13/1827 |
| 2021/0171105 | A1 * | 6/2021 | Spurling | B62D 21/11 |
| 2021/0172364 | A1 * | 6/2021 | Spurling | F01N 13/1844 |

FOREIGN PATENT DOCUMENTS

| | | | |
|---|---|---|---|
| DE | 102016111301 | A1 | 12/2017 |
| JP | 2005133546 | A | 5/2005 |
| JP | 2009029151 | A | 2/2009 |
| JP | 2009241793 | A | 10/2009 |

(Continued)

*Primary Examiner* — J. Todd Newton

(74) *Attorney, Agent, or Firm* — Vincent Mastrogiacomo; McCoy Russell LLP

(57) ABSTRACT

Systems are provided for a coupling element. In one example, the coupling element comprises a rotating element configured to rotate an aftertreatment device relative to a section of an exhaust passage in response to a force greater than a threshold force.

19 Claims, 3 Drawing Sheets

(56) References Cited

FOREIGN PATENT DOCUMENTS

| | | | | | |
|---|---|---|---|---|---|
| JP | 5381937 | B2 | | 1/2014 | |
| JP | 5521701 | B2 | | 6/2014 | |
| JP | 2020056395 | A | * | 4/2020 | ..... F01N 3/021 |

* cited by examiner

SYSTEMS FOR A FASTENING DEVICE OF AN EXHAUST-GAS AFTERTREATMENT SYSTEM

CROSS-REFERENCE TO RELATED APPLICATIONS

The present application claims priority to German Patent Application No. 102019133107.2 filed on Dec. 5, 2019. The entire contents of the above-listed application is hereby incorporated by reference for all purposes.

FIELD

The present description relates generally to a fastening device of an exhaust-gas aftertreatment system.

BACKGROUND/SUMMARY

In the field of motor vehicles with internal combustion engines (combustion machines), it is known for components to recirculate exhaust gas to an inlet side of the internal combustion engines, and/or components for purification of the exhaust gas, to be used in an exhaust-gas section of the internal combustion engines.

Owing to more stringent existing and future exhaust-gas regulations, there may be a high demand for installation space for components for exhaust-gas aftertreatment, such as for example exhaust-gas catalytic converter, nitrogen oxide trap (Lean NOx Trap), diesel particle filter or gasoline particle filter and urea injector. For reasons relating to technical process implementation, it is often necessary for the components for exhaust-gas aftertreatment to be arranged in the immediate vicinity of the internal combustion engine. In motor vehicles, with an engine compartment arranged at the front, this demand for installation space competes with the demand for deformation zones for minimizing component degradation in the case of a deformation event. An additional demand for installation space exists in the case of mechanical all-wheel-drive (AWD) power transmission units, which occupy or limit the installation space at the lower rear side of the drivetrain and thus demand for the components for exhaust-gas aftertreatment to be led around these restrictions.

One factor to consider includes the components arranged the engine compartment may be arranged close to one another in order to attain a compact construction. However, this increases the likelihood of oscillations or vibrations being transmitted between the components. This may not be desired due to NVH (noise, vibration, harshness) demands and in particular for vibration-sensitive components such as an exhaust-gas catalytic converter.

As a solution, DE 10 2016 111 301 A1 proposes a device for the suspension of a first component, which may be a component of a drivetrain of a motor vehicle, on a second component, which is spaced apart from said first component and which may be a component of an underbody of the motor vehicle, with a suspension element. In this way, it is possible to provide an elastic suspension for effective vibration decoupling for example of components of the exhaust-gas tract and the underbody of the motor vehicle with relatively low stiffness in a vertical direction of the motor vehicle and with relatively high stiffness in a transverse direction of the motor vehicle, with simultaneously low costs for the suspension.

The suspension element comprises a first bearing section for mounting on the first component and a second bearing section for mounting on the second component. Here, the bearing sections of the suspension elements are connected to one another via a connecting section which is formed at least partially from an elastomer and which is under tensile load in the suspended state. The device is equipped with a stop element which is arranged in the region of the connecting section so as to limit a deflection of at least one section of the connecting section in at least one direction transversely with respect to the longitudinal extent that connects the bearing sections. Such a device ma allow the suspension element and in particular the connecting section thereof to be designed primarily with regard to desired deformability in the longitudinal direction thereof, whereas the possibility of a deformation of the connecting section in at least one direction oriented transversely and perpendicularly with respect to the longitudinal direction is limited by the stop element.

JP 2005 133 546 A proposes a solution for an exhaust-gas structure of an internal combustion engine with turbocharger. In order, in an exhaust-gas channel of the internal combustion engine, to reduce a spacing between an exhaust-gas catalytic converter on the downstream side of the turbocharger and a bulkhead, the internal combustion engine and the transmission are installed vertically in an engine compartment in front of the bulkhead, and the turbocharger is attached, via the exhaust-gas manifold, on one side of the internal combustion engine in a lateral direction. Here, the front end of the exhaust-gas channel, which is arranged between the exhaust-gas catalytic converter and the turbocharger, is connected via a seal ring to an outlet opening of the turbocharger, which outlet opening is directed toward the bulkhead. By absorption of engine vibrations by means of the sealing ring, a spacing of the turbocharger to the exhaust-gas catalytic converter on the downstream side can be reduced.

The competing demands for installation space within the engine compartment demonstrate a constant conflict with the given dimensions of the front end of the motor vehicle and the platform capabilities thereof with regard to free deformation zones. The space for free deformation zones is reduced with every non-deformable component that is added in the vehicle front end. This increases the risk of undesired interventions into the passenger compartment in the case of a frontal deformation event, with the consequence of a considerable increase in a deceleration of vehicle occupants and an increase of the vehicle pulse index (VPI).

JP 5521701 B2 discloses a drive-power-transmitting device specifically for motor vehicles with an internal combustion engine arranged in a vehicle front end and with rear-wheel drive. The drive-power-transmitting device comprises a drive unit which is provided at the front side of a vehicle body in front of a bulkhead and which generates drive power, a differential transmission which is provided at a rear end of the vehicle body, and a power-transmitting shaft for transmitting the drive power of the drive unit to the differential transmission. The drive unit may be in the form of an internal combustion engine with an exhaust-gas device which comprises an exhaust-gas catalytic converter. Between the bulkhead and the rear side of the drive unit, a free space is provided toward the rear, and the exhaust-gas device is arranged in the free space. The power-transmitting shaft is divided into two parts which are connected via a universal joint and which are displaceable relative to one another if a predetermined force in a longitudinal direction is exceeded, for example in the event of a frontal impact. Upon the onset of a frontal impact event, the internal combustion engine and the exhaust-gas catalytic converter can be displaced into the free space, and the two parts of the power-transmitting shaft can be pushed one inside the other.

As an example, JP 2009 241 793 A describes a front part structure of a body of a motor vehicle, with which, even in the case of a relatively large exhaust-gas catalytic converter container, degradation of a bulkhead in the case of a frontal contact event of the motor vehicle can be blocked. The front part structure comprises a subframe, which is provided below a front side frame of the front part structure and to which lower arms of a front wheel suspension apparatus are attached. An engine is held on the subframe and the front side frames. An outlet opening of the engine is provided at the vehicle body front side. The subframes are equipped with right-hand and left-hand longitudinal members which extend in a longitudinal direction of the vehicle body to the left and to the right in front of the engine. A catalytic converter container with a horizontal element for the connection of a vertical element in the direction of the vehicle width is connected to the engine via an exhaust-gas pipe and is formed in an elongate shape in which exhaust-gas pipes are connected to both ends in the longitudinal direction. The catalytic converter container is arranged so as to extend, in the direction of the vehicle width, in the space between the cross member and the engine.

Since the outlet opening of the engine is provided on the surface of the engine at the front side of the vehicle body, the catalytic converter container can be arranged in front of the engine, while at the same time the outlet pipe can be shortened. Thus, because the catalytic converter container is arranged in front of the engine, a contact of the catalytic converter container with the bulkhead can be blocked, even if the engine is pushed rearward in the case of a frontal contact event.

Furthermore, JP 2009029151 A has disclosed a structure for the installation of a drivetrain of a vehicle. The structure comprises a bulkhead arranged between a passenger compartment and an engine compartment, which bulkhead is equipped with a cut-out section which faces toward the rear side of a vehicle body and which serves for covering a tunnel. A drivetrain for driving the rear wheels of the vehicle is arranged partially in the tunnel and the cut-out section. A heat exchanger for cooling the drivetrain, and an exhaust-gas pipe which extends from the drivetrain to the front side of the vehicle body, are arranged in front of the drivetrain. An exhaust-gas aftertreatment unit, which may be in the form of an exhaust-gas catalytic converter, is arranged in front of the heat exchanger in the direction of a width of the vehicle and is equipped with a device which promotes a rearward movement of the exhaust-gas aftertreatment unit in accordance with a mechanical load acting from the front in the event of a frontal vehicle deformation. The device comprises, on both sides of the exhaust-gas aftertreatment unit, rearwardly leading exhaust-gas pipes which are inclined rectilinearly upward at a predetermined angle in their front section and which have a substantially horizontally running rear section, wherein the front and rear sections are connected by a curved section. Upon the onset of a frontal impact event, the exhaust-gas aftertreatment unit together with the front sections of the exhaust-gas pipes are pivoted upward, with the curved sections as centers of rotation, wherein the drivetrain is conveyed further rearward in the cut-out section of the bulkhead.

Furthermore, JP 5381937 B2 describes an exhaust-gas apparatus of a vehicle, which exhaust-gas apparatus is designed such that the discharged exhaust gas is recirculated to the intake side via an exhaust-gas recirculation system (EGR system), wherein, in the direction of the vehicle width, an exhaust-gas purification unit is situated closer than the turbocharger to the outer side. The exhaust-gas recirculation system comprises an EGR cooler, which is arranged between a rear side wall surface of the engine and the exhaust-gas purification unit, an EGR control valve unit, which is arranged at a downstream side of the EGR cooler and which serves for the control of the exhaust-gas recirculation flow rate, a first EGR line for the feed of exhaust gas to the EGR cooler, and a second EGR line for the feed of exhaust gas discharged from the EGR cooler to the EGR control valve unit. A third EGR line is provided in order to discharge the exhaust gas discharged from the control valve unit to the inlet side of the engine. The turbocharger and the exhaust-gas purification unit are arranged adjacent to one another, in the direction of a vehicle width, on that side of the engine which faces toward the vehicle rear side.

The second EGR pipe is installed so as to extend between the turbocharger and the exhaust-gas purification unit to the vehicle rear side. The EGR control valve unit is arranged at a downstream side of the exhaust-gas purification unit, as viewed in the direction from front to rear of the vehicle, in the region of the tunnel section of the bulkhead. Thus, the turbocharger, the exhaust-gas purification unit, the EGR cooling device, the EGR control valve unit etc. can be arranged around the engine in a compact manner without interfering with one another. Furthermore, if an impact load acts in the direction of the rear end at the time of a contact of the vehicle, movement of the EGR control valve unit can be decreased in an effective manner.

One example solution for obtaining a space for deformation zones within the engine compartment despite an increase of a number of non-deformable components for exhaust-gas aftertreatment is an increase in length of the vehicle front end, which would however considerably increase the weight of the motor vehicle, which is not desired.

In view of the above previous examples highlighted, the field of fastening devices for components for the exhaust-gas aftertreatment of an internal combustion engine, which is arranged in particular in an engine compartment of a vehicle front end, still has potential for improvement.

In one example, the issues described above may be addressed by a system for a coupling element coupled to an aftertreatment device in an exhaust gas passage downstream of a turbocharger relative to a direction of exhaust gas flow, wherein the coupling element comprises a rotatable bearing configured to rotate the aftertreatment device relative to the turbocharger in response to a force greater than a threshold force. In this way, a travel path of the aftertreatment device may be altered during a vehicle deformation to decrease an amount of deformation to one or more components.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 1-2 are shown approximately to scale however other relative dimensions may be used.

DETAILED DESCRIPTION

Figure 1:
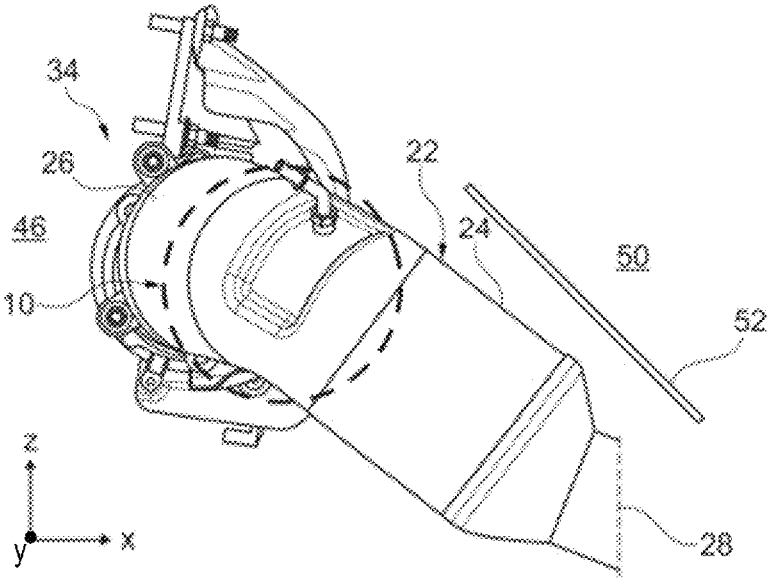
FIG. 1 shows a part of an exhaust-gas path of an internal combustion engine having a component for exhaust-gas aftertreatment and having a fastening device according to the disclosure in an installation state in a schematic side view.
Figure 2:
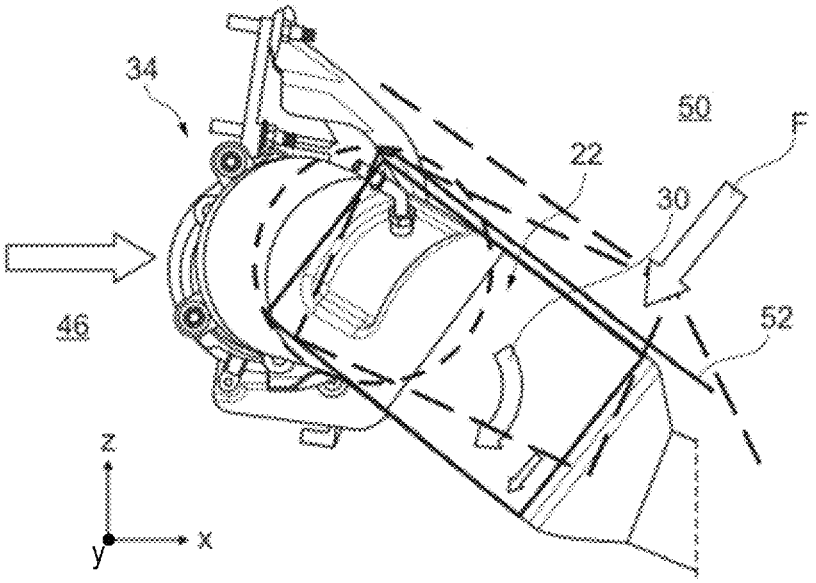
FIG. 2 shows the exhaust-gas path as per FIG. 1 in the same view after the onset of a frontal deformation event.
Figure 3:
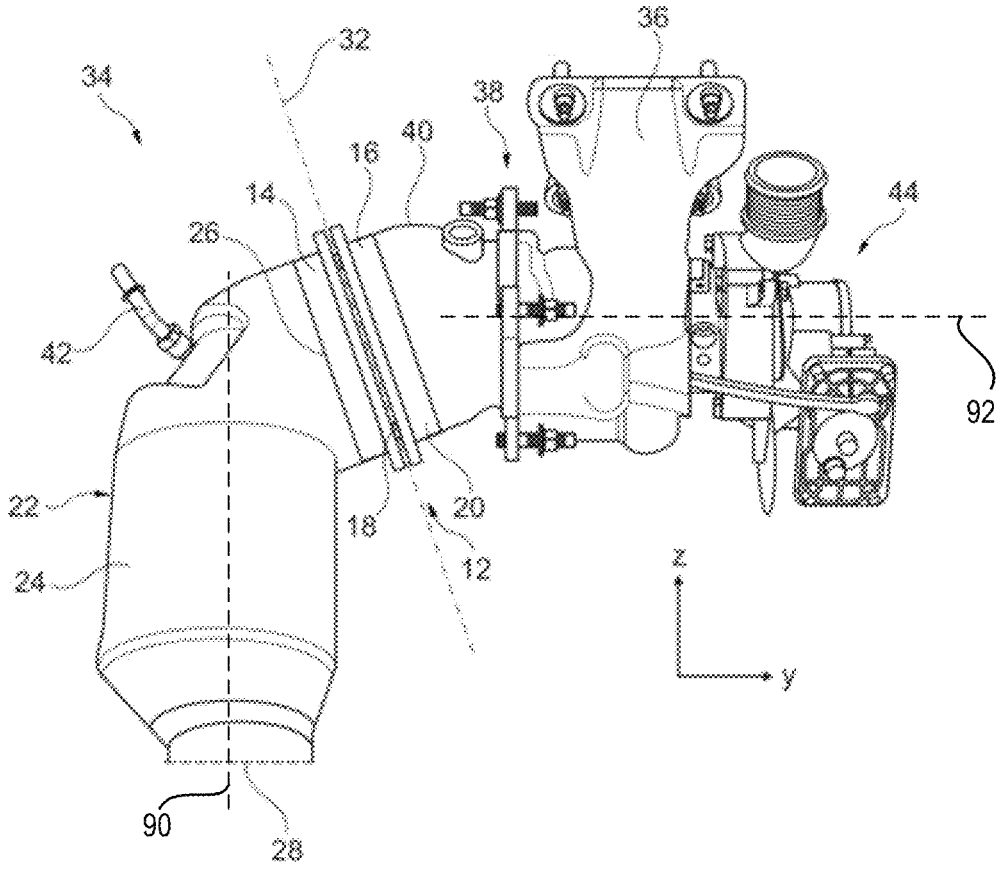
FIG. 3 shows the exhaust-gas path as per FIG. 1 in the installed state in a schematic rear view.
Figure 4:
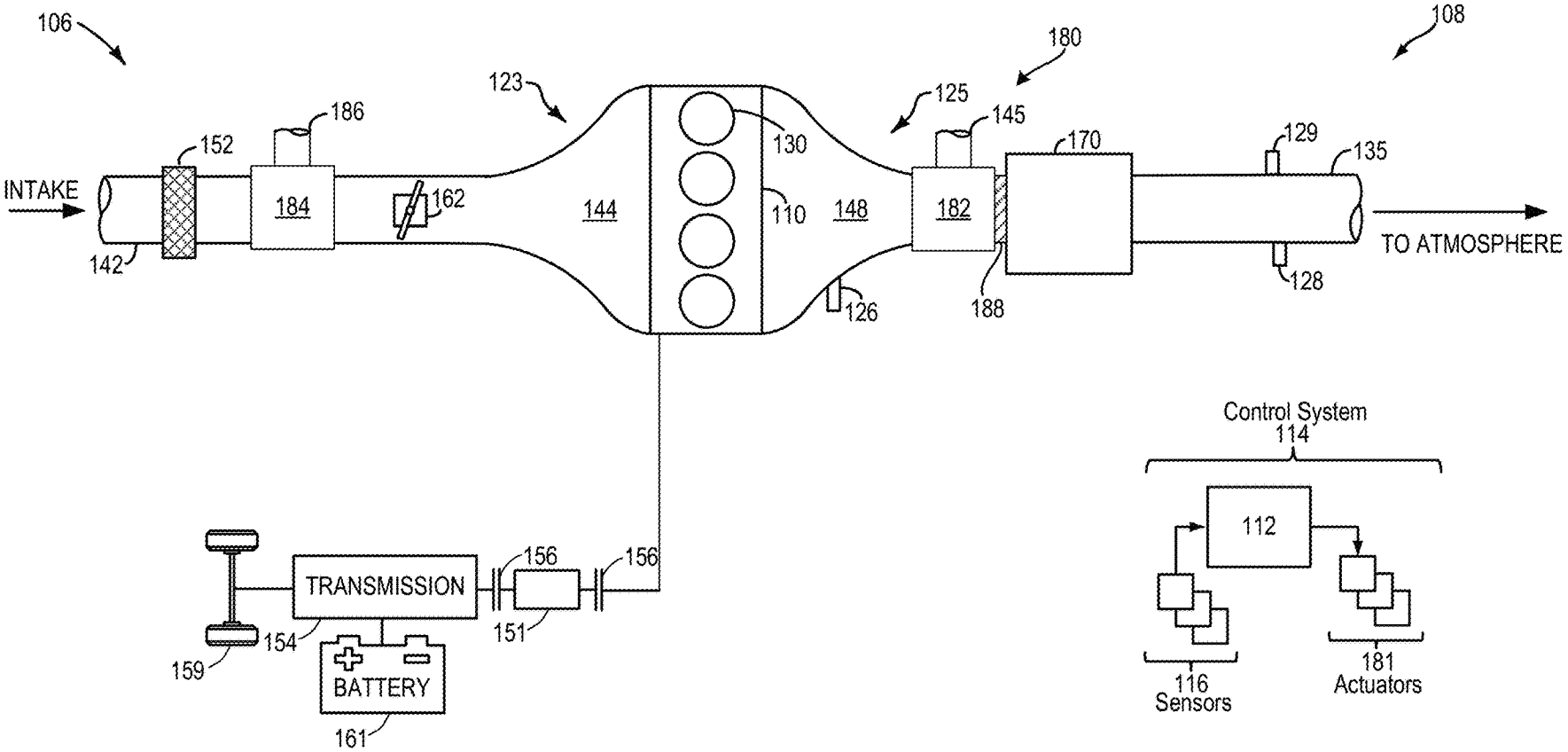
FIG. 4 illustrates a schematic of an engine included in a hybrid vehicle.

The following description relates to a fastening device. FIG. 1 shows a part of an exhaust-gas path of an internal combustion engine having a component for exhaust-gas aftertreatment and having a fastening device according to the disclosure in an installation state in a schematic side view. FIG. 2 shows the exhaust-gas path as per FIG. 1 in the same view after the onset of a frontal deformation event. FIG. 3 shows the exhaust-gas path as per FIG. 1 in the installed state in a schematic rear view. FIG. 4 illustrates a schematic of an engine included in a hybrid vehicle.

In one example, the fastening device, according to the disclosure, serves for the fastening of at least one component for exhaust-gas aftertreatment in an exhaust-gas path of a motor vehicle internal combustion engine. The at least one component has at least one exhaust-gas inlet opening and at least one exhaust-gas outlet opening which, in an installed state, is arranged behind the exhaust-gas inlet opening in relation to a direction of straight-ahead travel. Here, the fastening device comprises a coupling device which is arranged between a section of the exhaust-gas path and the at least one exhaust-gas inlet opening in order to ensure a fluidic connection between these. If a vertically downwardly directed force above a predetermined magnitude acts, the coupling device allows a downward pivoting movement of the at least one component, wherein a plane of rotation lies in the coupling device and substantially in a vertical plane parallel to the direction of straight-ahead travel.

In the context of the disclosure, a "plane of rotation" is to be understood to mean a plane about which, if the threshold for the vertically downwardly directed force is exceeded, a downward pivoting movement of the at least one component can occur, wherein parts of the coupling device which lie in the plane of rotation in the installed state move within the plane of rotation during the downward pivoting movement. In the context of the disclosure, the expression "substantially in a vertical plane" is to be understood in particular to mean that a magnitude of a perpendicularly projected area of the plane of rotation onto the vertical plane amounts to at least 50%, preferably at least 60% and particularly preferably at least 70%, of the area of the rotary plane.

In the case of deformation to a front of the vehicle, the motor vehicle internal combustion engine together with the exhaust-gas path is accelerated counter to the direction of straight-ahead travel. As a result, the exhaust-gas path and in particular the at least one component for exhaust-gas aftertreatment come into mechanical contact with the closest object arranged behind the component in relation to the direction of straight-ahead travel. This closest object, which may for example be in the form of a bulkhead, thus exerts a force on the at least one component for exhaust-gas aftertreatment. If this force at least reaches the predetermined level, the coupling device allows the downward pivoting movement of the at least one component for exhaust-gas aftertreatment and possibly of further components arranged downstream. In this way, a movement of the at least one component for exhaust-gas aftertreatment counter to the direction of straight-ahead travel can be limited. In this way, contact of the at least one component for exhaust-gas aftertreatment with the bulkhead, can be blocked or mitigated in an effective manner. As a result of the limitation of the movement of the at least one component for exhaust-gas aftertreatment in the case of a frontal deformation event, it is possible in the engine compartment to use statically larger and thus more powerful other components, for example for exhaust-gas aftertreatment or for other purposes, because, owing to the dynamic compaction of the at least one component for exhaust-gas aftertreatment, less free deformation space ("free space") is taken up.

The fastening device according to the disclosure may be usable for a drivetrain which is composed of an internal combustion engine and connected transmission and which is arranged at least partially in an engine compartment in a vehicle front end of a motor vehicle. A "motor vehicle" is to be understood in the context of this disclosure to mean in particular a passenger motor vehicle, a heavy goods vehicle, a tractor machine, or a motor bus.

The component for exhaust-gas aftertreatment may, without restriction to this, be in the form of an exhaust-gas catalytic converter, nitrogen oxide trap (Lean NOx Trap), diesel particle filter or gasoline particle filter or urea injector.

In some embodiments of the fastening device, a dimension of the coupling device in the plane of rotation at least corresponds to a dimension of the exhaust-gas inlet opening of the at least one component. In this way, expedient flow conditions for the conveyance of the exhaust gas with low pressure losses can be attained.

In some examples, the coupling device includes a seal element for sealing off the fluidic connection between the section of the exhaust-gas path and the at least one exhaust-gas inlet opening with respect to an outside space. Firstly, the seal element prevents an escape of exhaust gas from the coupling device. Secondly, the seal element that is used can, in the case of a suitable design of the coupling device, be used to form, in a simple manner in terms of construction, a pivot joint for allowing the downward pivoting movement.

In some embodiments of the fastening device, the coupling device comprises two flanges with corresponding sealing surfaces, between which the seal element is arranged in the installed state. In this way, it is possible in a simple manner in terms of construction to provide a fluidic connection between the section of the exhaust-gas path and the at least one exhaust-gas inlet opening of the at least one component for exhaust-gas aftertreatment, which fluidic connection is sealed off in an improved manner with respect to the outside space via the seal element. Furthermore, via an adjustment of the contact pressure and a suitable selection of shape and material of the seal element between the corresponding sealing surfaces, it is possible to set the predetermined level of the vertically downwardly directed force above which the downward pivoting movement is allowed.

The flanges may for example be in the form of welded-on flanges, wherein one of the welded-on flanges may be welded to an end, facing toward the component for exhaust-gas aftertreatment, of the section of the exhaust-gas path, and the other of the welded-on flanges may be welded to the at least one exhaust-gas inlet opening.

The seal element may be resistant to high temperatures. Materials for the seal element, which are resistant to high temperatures, may include graphite foil and composite materials comprising mica and high-grade steel. In the context of this disclosure, the expression "resistance to high temperatures" is to be understood in particular to mean that such a material maintains mechanical characteristics which satisfy the predefined limits up to a temperature of at least 550° C., preferably at least 600° C. and particular preferably at least 700° C. In this way, the seal element can be used with many types of components for exhaust-gas aftertreatment.

In some embodiments of the fastening device, in the coupling device, there is formed a cavity which has an inner surface with low surface roughness and which is free from constrictions, shoulders or orifices. In this way, expedient flow conditions for the conveyance of the exhaust gas with low pressure losses can be attained.

In some embodiments, the inner surface of the cavity is predominantly coated with a rust-inhibiting agent. In the context of the disclosure, the expression "predominantly" is to be understood in particular to mean a proportion of more than 70 vol. %, preferably of more than 80 vol. % and particularly preferably of more than 90 vol. %. In particular, the expression is intended to encompass the possibility that the entirety, that is to say 100 vol. %, of the inner surface of the cavity is equipped with rust-inhibiting properties. In particular, in this way, a formation of rust on the sealing surfaces of the flanges can be blocked.

In some embodiments of the fastening device, all constituent parts which form the coupling device are composed of materials resistant to high temperatures. In this way, the proposed coupling device can be used with a large number of different types of components for exhaust-gas aftertreatment.

In a further aspect of the disclosure, an exhaust-gas path of a motor vehicle internal combustion engine, having at least one component for exhaust-gas aftertreatment, is provided. The exhaust-gas path has at least an embodiment of the proposed fastening device. Here, the coupling device is arranged between the section of the exhaust-gas path and the at least one exhaust-gas inlet opening. The advantages described in conjunction with the fastening device are transferable in full to the exhaust-gas path of the motor vehicle internal combustion engine.

In some embodiments of the exhaust-gas path, the at least one component for exhaust-gas aftertreatment is arranged in front of a bulkhead in relation to the direction of straight-ahead travel of the motor vehicle and in the vicinity of said bulkhead. In this way, the closest object which is arranged behind the component for exhaust-gas aftertreatment in relation to the direction of straight-ahead travel and with which the at least one component comes into mechanical contact in the case of a frontal deformation event may be formed by the bulkhead. Owing to the proximity of the at least one component for exhaust-gas aftertreatment to the bulkhead that is made possible owing to the disclosure, it is possible for statically larger other components, for example for exhaust-gas aftertreatment or else for other purposes, to be used in the engine compartment.

FIGS. 1-4 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation), such differences also representing the term approximately as used herein.

In the various figures, identical parts are always denoted by the same reference designations, for which reason said parts will generally also be described only once.

FIG. 1 shows a part of an exhaust-gas path 34 of an internal combustion engine (not illustrated) and with a fastening device 10 according to the disclosure in an installation state in a schematic side view. The internal combustion engine is part of a drivetrain of a motor vehicle which comprises the internal combustion engine and a transmission illustrated in FIG. 4. The internal combustion engine is arranged in an engine compartment 46 of a vehicle front end of the motor vehicle.

The exhaust-gas path 34 comprises a turbocharger 36, shown in FIG. 3, for attachment to a cylinder head of the internal combustion engine and comprises a component 22 for exhaust-gas aftertreatment which is attached to said turbocharger 36 via a flange connection 38 on a section 40 of the exhaust-gas path 34. The component 22 for exhaust-gas aftertreatment is formed by an exhaust-gas catalytic converter with a metallic housing 24, in which there is arranged a lambda probe 42 as a sensor of a lambda control system for catalytic exhaust-gas purification. A compressor housing 44 is furthermore flange-mounted on the outlet of the turbocharger 36. The exhaust-gas catalytic converter is, in relation to a direction of straight-ahead travel of the motor vehicle, which corresponds to the –X direction, arranged in front and in the vicinity of a bulkhead 52 (FIG. 1) which separates the engine compartment 46 from a passenger compartment 50 of the motor vehicle.

As shown in FIG. 3, the component 22 comprises a central axis 90. Exhaust gas flow through the component 22 may be parallel to the central axis 90. The turbocharger 36 comprises a central axis 92. Exhaust gas flow from the turbocharger to the section 40 may be parallel to the central axis 92. In one example, the central axis 90 is normal to the central axis 92, wherein the section 30 may comprise a bend or other deviation from the central axes such that it is angled to each of the central axis 90 and the central axis 92.

Referring to FIG. 1, the exhaust-gas path 34 has the fastening device 10 according to the disclosure, which serves for the fastening of the component 22 for exhaust-gas aftertreatment, specifically the exhaust-gas catalytic converter, to the exhaust-gas path 34. The housing 24 of the exhaust-gas catalytic converter comprises an exhaust-gas inlet opening 26 and an exhaust-gas outlet opening 28. The exhaust-gas outlet opening 28 is, in the installed state illustrated in FIG. 1, arranged behind the exhaust-gas inlet opening 26 in relation to the direction of straight-ahead travel. That is to say, the exhaust-gas outlet opening 28 is arranged downstream of the exhaust-gas inlet opening 26, wherein the fastening device 10 is configured to physically couple the component 22 to the exhaust-gas path 34 at a location downstream of the turbocharger relative to a direction of exhaust gas flow.

The fastening device 10 comprises a coupling device 12, shown in FIG. 3, which is arranged between the section 40 of the exhaust-gas path 34 and the exhaust-gas inlet opening 26 of the catalytic converter and which ensures a fluidic connection between these. The coupling device 12 comprises two flanges 14, 16 which are in the form of welded-on flanges. A first flange 14 is welded to the housing 24 of the catalytic converter at the exhaust-gas inlet opening 26 of the catalytic converter. The second flange 16 is welded to an end, facing toward the catalytic converter, of the section 40 of the exhaust-gas path 34. Each of the flanges 14, 16 has a sealing surface which corresponds with the sealing surface of the other flange 14, 16.

The sealing surfaces of the first flange 14 and the second flange 16 can be placed in contact with one another in the installed state in order to produce the fluidic connection. To improve the sealing action of the fluidic connection with respect to an outside space, the coupling device 12 may have a seal element 18 which is arranged between the sealing surfaces of the first and second flanges 14, 16. The seal element 18 may for example be in the form of a circular-ring-shaped flat seal and have a predominant proportion of a material which is stable at high temperatures, for example graphite foil or a combination of mica and high-grade steel.

In general, all constituent parts which form the coupling device 12 are composed of materials resistant to high temperatures.

In the installed, non-deformed state of the coupling device 12, the first and second flanges 14, 16 are pressed against one another for the purposes of sealing. This may be realized for example via a V-profile clamp (not illustrated) such as is widely used in automotive engineering as a connecting element in exhaust-gas paths.

The contact pressure between the sealing surfaces of the first and second flanges 14, 16 can be set through selection of a tightening torque at the V-profile clamp. Through the combination of set contact pressure, the material of the seal element 18 and the condition of the sealing surfaces of the flanges 14, 16, a minimum value for a force able to perform a downward pivoting movement of the catalytic converter is defined. It is thus possible for a minimum level of the force for the downward pivoting movement of the catalytic converter to be predetermined and set through selection of suitable parameters.

FIG. 2 shows the exhaust-gas path 34 as per FIG. 1 in the same view after the onset of a deformation to a front of the vehicle, in the case of which the drivetrain together with the exhaust-gas path 34 accelerates counter to the direction of straight-ahead travel, that is to say in the +X direction, and is displaced relative to the bulkhead 52. In the event of a sufficiently large displacement, the catalytic converter may come into mechanical contact with the bulkhead 52. In the case of a further increasing relative displacement, the bulkhead 52 exerts a force F with a vertically downwardly directed force component on the catalytic converter.

The bulkhead 52 has a maximum mechanical load capacity which is several times greater than the minimum level of the force for the downward pivoting movement 30 of the catalytic converter. In the event of a further increase of the relative displacement between the exhaust-gas catalytic converter and the bulkhead 52, the minimum level of the force for the downward pivoting movement 30 of the catalytic converter is reached and exceeded. The coupling device 12 then allows the downward pivoting movement 30 of the catalytic converter. The downward pivoting movement 30 occurs in a plane of rotation 32 (FIG. 3), whereby a movement of the exhaust-gas catalytic converter counter to the direction of straight-ahead travel can be limited.

The plane of rotation 32 lies within the coupling device 12 and is arranged parallel to the sealing surfaces of the first and second flanges 14, 16 of the coupling device 12. The plane of rotation 32 lies substantially in a vertical plane which is oriented parallel to the direction of straight-ahead travel. A dimension of the coupling device 12 in the plane of rotation 32 is defined by an inner diameter of the sealing surfaces of the first and second flanges 14, 16 and corresponds substantially to an inner diameter of the exhaust-gas inlet opening 26 of the housing of the catalytic converter, whereby expedient flow conditions with regard to a pressure drop within the coupling device 12 can be attained in a normal operating state of the exhaust-gas path 34.

Via the two welded-on flanges and the pipe attachment pieces thereof, a cavity 20 is formed in the coupling device 12. The cavity 20 has an inner surface with a low surface roughness and is free from constrictions, shoulders or orifices, which counteracts a pressure loss in the flow through the coupling device 12.

For protection against corrosion, the inner surface of the cavity 20 may be entirely coated with a rust-inhibiting agent.

In FIG. 2, dashed lines are used to show an expected movement of the exhaust-gas catalytic converter in the case of a frontal deformation event without the fastening device 10 according to the disclosure. As illustrated, through the use of the fastening device 10 according to the disclosure, an amount of contact of the exhaust-gas catalytic converter with the bulkhead 52 can be mitigated in an effective manner.

In one example, the coupling device 12 is configured to rotate only in response to a threshold force. In one example, the threshold force is based on a force greater than forces experienced during driving conditions outside of a vehicle deformation. Additionally or alternatively, the threshold force may be based on a force generated between the bulkhead 52 and the component 22 during a vehicle deformation. The threshold force may be fine-tuned such that degradation to the bulkhead 52 does not occur in response to contact between the bulkhead 52 and the component 22 while still blocking the component 22 from inadvertently rotating during vehicle operations where contact between the bulkhead 52 and the component 22 does not occur.

FIG. 4 shows a schematic depiction of a hybrid vehicle system 106 that can derive propulsion power from engine system 108 and/or an on-board energy storage device. An energy conversion device, such as a generator, may be operated to absorb energy from vehicle motion and/or engine operation, and then convert the absorbed energy to an energy form suitable for storage by the energy storage device.

Engine system 108 may include an engine 110 having a plurality of cylinders 130. Engine 110 includes an engine intake 123 and an engine exhaust 125. Engine intake 123 includes an air intake throttle 162 fluidly coupled to the engine intake manifold 144 via an intake passage 142. Air may enter intake passage 142 via air filter 152. Engine exhaust 125 includes an exhaust manifold 148 leading to an exhaust passage 135 that routes exhaust gas to the atmosphere. Engine exhaust 125 may include one or more emission control devices 170 mounted in a close-coupled position or in a far underbody position. The emission control devices 170 may be substantially similar to the component 22 of FIG. 1. As such, the emission control devices 170 may comprise a fastener element configured to adjust a direction of travel of one or more aftertreatment devices in response to a vehicle deformation. The one or more emission control devices may include a three-way catalyst, lean NOx trap, diesel particulate filter, oxidation catalyst, etc. It will be appreciated that other components may be included in the engine such as a variety of valves and sensors, as further elaborated in herein. In some embodiments, wherein engine system 108 is a boosted engine system, the engine system may further include a boosting device, such as a turbocharger 180. The turbocharger 180 may comprise a turbine 182, a compressor 184, and a shaft 186 configured to mechanically couple the turbine 182 to the compressor 184. The compressor 184 may be arranged in compressor housing 44 of FIG. 3 as a non-limiting example.

A coupling device 188 is arranged between an exhaust side of the turbocharger 180 and the emission control device 170. In one example, the coupling device 188 and the emission control device are used identically to the coupling device 12 and the component 22 of FIG. 1. As such, the coupling device 188 may be configured to allow the emission control device 170 to rotate in response to a force.

Vehicle system 106 may further include control system 114. Control system 114 is shown receiving information from a plurality of sensors 116 (various examples of which are described herein) and sending control signals to a plurality of actuators 181 (various examples of which are described herein). As one example, sensors 116 may include exhaust gas sensor 126 located upstream of the emission control device, temperature sensor 128, and pressure sensor 129. Other sensors such as additional pressure, temperature, air/fuel ratio, and composition sensors may be coupled to various locations in the vehicle system 106. As another example, the actuators may include the throttle 162.

Controller 112 may be configured as a conventional microcomputer including a microprocessor unit, input/output ports, read-only memory, random access memory, keep alive memory, a controller area network (CAN) bus, etc. Controller 112 may be configured as a powertrain control module (PCM). The controller may be shifted between sleep and wake-up modes for additional energy efficiency. The controller may receive input data from the various sensors, process the input data, and trigger the actuators in response to the processed input data based on instruction or code programmed therein corresponding to one or more routines.

In some examples, hybrid vehicle 106 comprises multiple sources of torque available to one or more vehicle wheels 159. In other examples, vehicle 106 is a conventional vehicle with only an engine, or an electric vehicle with only electric machine(s). In the example shown, vehicle 106 includes engine 110 and an electric machine 151. Electric machine 151 may be a motor or a motor/generator. A crankshaft of engine 110 and electric machine 151 may be connected via a transmission 154 to vehicle wheels 159 when one or more clutches 156 are engaged. In the depicted example, a first clutch 156 is provided between a crankshaft and the electric machine 151, and a second clutch 156 is provided between electric machine 151 and transmission 154. Controller 112 may send a signal to an actuator of each clutch 156 to engage or disengage the clutch, so as to connect or disconnect crankshaft from electric machine 151 and the components connected thereto, and/or connect or disconnect electric machine 151 from transmission 154 and the components connected thereto. Transmission 154 may be a gearbox, a planetary gear system, or another type of transmission. The powertrain may be configured in various manners including as a parallel, a series, or a series-parallel hybrid vehicle.

Electric machine 151 receives electrical power from a traction battery 161 to provide torque to vehicle wheels 159. Electric machine 151 may also be operated as a generator to provide electrical power to charge battery 161, for example during a braking operation.

In this way, an aftertreatment device may be urged in a direction away from a remainder of a vehicle in response to a vehicle deformation. A coupling element, which may be configured to rotate in response to a force, may adjust a position of the aftertreatment device during a deformation such that the aftertreatment device travel less in a direction parallel to a direction of vehicle motion. In one example, the coupling element rotates in response to a force between the bulkhead and the aftertreatment device. The technical effect of the coupling element is to decrease an amount of space needed between the aftertreatment device and the bulkhead, which may provide a greater amount of packaging space for other engine components.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system, comprising:

a coupling element coupled to an aftertreatment device in an exhaust gas passage downstream of a turbocharger relative to a direction of exhaust gas flow, wherein the coupling element comprises a rotatable bearing configured to rotate the aftertreatment device relative to the turbocharger in response to a force greater than a threshold force, and wherein the rotatable bearing blocks rotation of the aftertreatment device in response to a force less than or equal to the threshold force.

2. The system of claim 1, wherein exhaust gases flow through an opening of the coupling element.

3. The system of claim 2, wherein surfaces of the coupling element shaping the opening are smooth.

4. The system of claim 1, wherein the force greater than the threshold force is generated in response to the aftertreatment device contacting a component.

5. The system of claim 4, wherein the component is arranged downstream of the aftertreatment device relative to a direction of vehicle travel.

6. The system of claim 1, wherein the coupling element is arranged at an inlet of the aftertreatment device.

7. A vehicle system, comprising:

a coupling element arranged between a section of an exhaust gas passage and an exhaust gas inlet of an aftertreatment device, wherein the coupling element comprises a rotatable bearing configured to pivot in a downward direction along a plane with an axis parallel to a direction of gravity, wherein the aftertreatment device pivots with the coupling element in response to a force exceeding a threshold force, and where the rotatable bearing blocks rotation of the aftertreatment device in response to a force less than or equal to the threshold force.

8. The vehicle system of claim 7, wherein the force is in the downward direction.

9. The vehicle system of claim 7, wherein the plane corresponds to a plane of the exhaust gas inlet.

10. The vehicle system of claim 7, wherein the coupling element comprises a sealing element configured to block exhaust gas from flowing to an ambient atmosphere as it flows from the section of the exhaust gas passage, through the coupling element, and through the exhaust gas inlet to the aftertreatment device.

11. The vehicle system of claim 7, wherein the force is generated in response to the aftertreatment device contacting a component.

12. The vehicle system of claim 11, wherein the aftertreatment device and the component are arranged in a vehicle front end.

13. The vehicle system of claim 7, wherein a turbocharger is arranged adjacent upstream of the section of the exhaust gas passage.

14. The vehicle system of claim 13, wherein the section is angled such that a central axis of the aftertreatment device is angled to a central axis of the turbocharger.

15. A system, comprising:

a coupling element arranged between a section of an exhaust gas passage and an exhaust gas inlet of an aftertreatment device, wherein a turbocharger is arranged upstream of the section of the exhaust gas passage, wherein the coupling element comprises a bearing element configured to pivot in a downward direction along a plane with an axis parallel to a direction of gravity, wherein the aftertreatment device pivots with the coupling element in response to a force exceeding a threshold force, and where the rotatable bearing blocks rotation of the aftertreatment device in response to a force less than or equal to the threshold force.

16. The system of claim 15, wherein exhaust gas flows parallel to a central axis of the aftertreatment device, and wherein the central axis of the aftertreatment device is normal to a central axis of the turbocharger.

17. The system of claim 16, wherein the turbocharger does not pivot when the coupling element pivots the aftertreatment device.

18. The system of claim 17, wherein the coupling element comprises a rotatable bearing arranged between a pair of flanges.

19. The system of claim 15, wherein the downward direction is normal to a direction of vehicle travel.

* * * * *